US007291845B2

(12) United States Patent
Moeller et al.

(10) Patent No.: US 7,291,845 B2
(45) Date of Patent: Nov. 6, 2007

(54) METHOD FOR CONTROLLING SPACE CHARGE-DRIVEN ION INSTABILITIES IN ELECTRON IMPACT ION SOURCES

(75) Inventors: Roy Moeller, San Leandro, CA (US); Felician Muntean, Danville, CA (US); Urs Steiner, Sunnyvale, CA (US)

(73) Assignee: Varian, Inc., Palo Alto, CA (US)

( * ) Notice: Subject to any disclaimer, the term of this patent is extended or adjusted under 35 U.S.C. 154(b) by 134 days.

(21) Appl. No.: 11/114,481

(22) Filed: Apr. 26, 2005

(65) Prior Publication Data

US 2006/0237641 A1 Oct. 26, 2006

(51) Int. Cl.
*H01J 27/00* (2006.01)

(52) U.S. Cl. ..... 250/427; 250/423 R

(58) Field of Classification Search ..... 250/427
See application file for complete search history.

(56) References Cited

U.S. PATENT DOCUMENTS

| | | | | |
|---|---|---|---|---|
| 2,784,317 | A * | 3/1957 | Robinson | 250/290 |
| 3,553,452 | A * | 1/1971 | Tiernan et al. | 250/287 |
| 6,294,780 | B1 * | 9/2001 | Wells et al. | 250/288 |
| 6,576,897 | B1 | 6/2003 | Steiner et al. | |

* cited by examiner

*Primary Examiner*—David A. Vanore
(74) *Attorney, Agent, or Firm*—Bella Fishman; David Gloekler

(57) ABSTRACT

In a method for inhibiting space charge-related effects in an ion source, an electron beam is directed into a chamber to produce ions from sample material in the chamber. A voltage pulse is applied to the chamber to perturb an electron space charge present in the chamber. The ion source may be an electron impact ionization (EI) apparatus. The ion source may operated in conjunction with a mass spectrometry system.

25 Claims, 6 Drawing Sheets

METHOD FOR CONTROLLING SPACE CHARGE-DRIVEN ION INSTABILITIES IN ELECTRON IMPACT ION SOURCES

FIELD OF THE INVENTION

The present invention relates generally to the ionization of sample material, which finds use, for example, in fields of analytical chemistry such as mass spectrometry. More particularly, the present invention relates to improving the performance of an ion source, and particularly an electron ionization source, by controlling ion instabilities that may occur in the ionization source.

BACKGROUND OF THE INVENTION

Mass spectrometry (MS) describes a variety of instrumental methods of qualitative and quantitative analysis that enable sample components to be resolved according to their mass-to-charge ratios. For this purpose, a mass spectrometer converts the components of a sample into ions, sorts or separates the ions based on their mass-to-charge ratios, and processes the resulting ion output (for example, ion current, flux, beam, signal, et cetera) as needed to produce a mass spectrum. Typically, a mass spectrum is a series of peaks indicative of the relative abundances of charged components as a function of mass-to-charge ratio. The term "mass-to-charge" is often expressed as m/z or m/e, or simply "mass" given that the charge z or e often has a value of 1. The information represented by the ion output can be encoded as electrical signals through the use of an appropriate transducer to enable data processing by analog and/or digital techniques.

Insofar as the present disclosure is concerned, MS systems are generally known and need not be described in detail. Briefly, a typical MS system generally includes a sample inlet system, an ion source or ionization system, a mass analyzer (also termed a mass sorter or mass separator) or multiple mass analyzers, an ion detector, a signal processor, and readout/display means. Additionally, the MS system typically includes an electronic controller such as a computer or other electronic processor-based device for controlling the functions of one or more components of the MS system, managing data acquisition, storing information produced by the MS system, providing libraries of molecular data useful for analysis, and the like. The electronic controller may include a main computer that includes a terminal, console or the like for enabling interface with an operator of the MS system, as well as one or more modules or units that have dedicated functions such as data acquisition and manipulation. The MS system also includes a vacuum system to enclose the mass analyzer(s) in a controlled, evacuated environment. In addition to the mass analyzer(s), depending on design, all or part of the sample inlet system, ion source, and ion detector may also be enclosed in the evacuated environment.

In operation, the sample inlet system introduces a small amount of sample material to the ion source, which may be integrated with the sample inlet system depending on design. In hyphenated techniques, the sample inlet system may be the output of an analytical separation instrument such as a gas chromatographic (GC) instrument, a liquid chromatographic (LC) instrument, a capillary electrophoresis (CE) instrument, a capillary electrochromatography (CEC) instrument, or the like. The ion source converts components of the sample material into a stream of positive and negative ions. One ion polarity is then accelerated into the mass analyzer. The mass analyzer separates the ions according to their respective mass-to-charge ratios. The mass analyzer produces a flux of ions resolved according to m/z ratio and the ions are collected at the ion detector.

The ion detector functions as a transducer that converts the mass-discriminated ionic information into electrical signals suitable for processing/conditioning by the signal processor, storage in memory, and presentation by the readout/display means. A typical ion detector includes, as a first stage, an ion-to-electron conversion device. Ions from the mass analyzer are focused toward the ion-to-electron conversion device by means of an electrical field and/or electrode structures that serve as ion optics. The electrical and structural ion optics are preferably designed so as to separate the ion beam from any neutral particles and electromagnetic radiation that may also be discharged from the mass analyzer, thereby reducing background noise and increasing the signal-to-noise (S/N) ratio. The ion-conversion stage may be followed by an electron-multiplier stage, which typically includes dynodes for multiplication and an anode for collecting the multiplied flux of electrons and transmitting an output electrical current to subsequent processes. Alternatively, a photomultiplier may be substituted for an electron multiplier and operated in a similar manner.

The output of an ion detector typically is an amplified electrical current proportional to the intensity of the ion current fed to the ion detector and the gain of the electron multiplier. This output current can be processed as needed to yield a mass spectrum that can be displayed or printed by the readout/display means. A trained analyst can then interpret the mass spectrum to obtain information regarding the sample material processed by the MS system.

Examples of ion sources include, but are not limited to, gas-phase ion sources and desorption ion sources. Ion, sources may also be characterized according to whether they implement hard ionization or soft ionization. One example of an ion source is an electron impact ionization (EI) source. In a typical EI source, sample material is introduced into a chamber in the form of a molecular vapor. A heated filament is employed to emit energetic electrons, which are collimated and accelerated as a beam into the chamber under the influence of a voltage potential impressed between the filament and an anode. The path of the beam of sample material into the chamber is typically orthogonal to the path of the electron beam. These paths intersect at a region within the chamber, where ionization of the sample material occurs as a result of the electron beam bombarding the sample material. The primary reaction of the ionization process may be described by the following relation:

$M+e^- \rightarrow M^{*+}2e^-$, where M designates an analyte molecule, $e^-$ designates an electron, and $M^{*+}$ designates the resulting molecular ion. That is, electrons approach a molecule closely enough to cause the molecule to lose an electron by electrostatic repulsion and, consequently, a singly-charged positive ion is formed. A voltage potential is employed to attract the ions formed in the chamber toward an exit aperture, after which the resulting ion beam is accelerated into the mass analyzer.

In the operation of an ion source, a phenomenon of ion beam self-oscillation may occur when the source is operated under high electron emission currents (hundreds of microamps) and strong magnetic fields (hundreds of Gauss) in order to maximize its sensitivity. This phenomenon may manifest itself by a quasi-periodic oscillation of the ion signal extracted toward the mass spectrometer, with frequencies that vary according to the conditions of the source over a wide range: from Hz to hundreds of kHz. When this self-oscillation phenomenon occurs, the performance of the mass spectrometer may be degraded, leading to poor peak area reproducibility, poor linearity, and inconsistent ion ratios measured. The phenomenon occurs with higher probability when high electron emission currents are employed, when the source is operated at low pressures (<1 mTorr), and when the ion extracting lens voltage is small (a few volts).

Based on experimental observation of the inventors in the present disclosure in the use of EI sources, the following mechanism for the observed self-oscillation phenomenon is proposed, with the understanding that there is no intention to limit any aspect of the present disclosure by such proposal. Inside the ion source, the electron space charge may create a potential well around the electron beam. The ions that are generated by the electrons may be trapped in this potential well for a finite time before they can be extracted toward the mass spectrometer. Under certain conditions, particularly when the electron density is maximized in order to maximize the sensitivity of the source, the trapped ions may only be able to escape the electron potential well after they accumulate in large number, through charge repulsion, in a burst. This mechanism of ion extracting could lead to the self-oscillation of the ion beam where a cycle consists of a short ion burst followed by a time when the ions are trapped and accumulate around the electron beam.

It is acknowledged, therefore, that a need exists for a solution that would inhibit the occurrence of the ion self-oscillation phenomenon but at the same time would preserve the overall sensitivity of the ion source. Experiments of the inventors in the present disclosure have indicated that the phenomenon of self-oscillation could be prevented by a series of possible actions. First, the self-oscillation could be prevented by reducing the electron density in the ion source, either through reducing the electron filament current or reducing the strength of the electron-collimating magnetic field. Unfortunately, for a given geometry of the ion source, this leads to a significant reduction of the overall sensitivity of the source. Second, the self-oscillation could be prevented by increasing the voltage applied on the first ion extracting lens, but this again is limited by a given source geometry, so it could lead to a significant decrease of the sensitivity of the source. Third, the self-oscillation could be prevented by increasing the background gas present in the source that usually is the carrier gas of the gas chromatograph, for example, helium. This pressure has a limited range of adjustment due to the specific flow rates needed to operate the gas chromatograph, so it is not presently deemed to be an acceptable solution either.

Accordingly, there continues to be a need for providing an adequate solution for controlling space charge-driven ion instabilities in ion sources, and particularly EI ion sources.

SUMMARY OF THE INVENTION

To address the foregoing problems, in whole or in part, and/or other problems that may have been observed by persons skilled in the art, the present disclosure provides methods for inhibiting space charge-related effects in an electron ionization source, and electron ionization apparatus that may be employed to implement the methods, as described by way of examples set forth below.

In one aspect, a method is provided for inhibiting space charge-related effects in an ion source. According to the method, an electron beam is directed into a chamber to produce ions from sample material in the chamber. A voltage pulse is applied to the chamber to perturb an electron space charge present in the chamber.

In some implementations, the operating parameters of the voltage pulse, such as pulse height, pulse width, and pulse frequency in the case of multiple voltage pulses, may be selected in whole or in part based on one or more operating parameters of other components of the ion source or the system in which the ion source operates. Examples of operating parameters of other components include, but are not limited to, data sampling frequency, electron emission current, pressure in the chamber, and ion mass in the chamber.

In some implementations, the voltage pulse is applied to a conductive surface disposed proximate to an aperture of the chamber, such that a pulsatile voltage potential is impressed between the conductive surface and a surface of or in the chamber. The conductive surface may be external to the chamber such as, for example, an ion extraction lens or an electron collection electrode, or the conductive surface may be internal to the chamber such as, for example, a repeller or reflector electrode.

In other implementations, the voltage pulse is applied to the chamber structure itself, such that a pulsatile voltage potential is impressed between the chamber structure and a conductive surface disposed in the chamber.

In other implementations, the voltage pulse is applied by pulsing the electron beam.

In another aspect, an ionization apparatus is provided. The apparatus comprises a chamber, an electron source for directing an electron beam into the chamber, and means for applying a voltage pulse to the chamber to perturb an electron space charge present in the chamber.

In some implementations, the voltage pulse applying means comprises a voltage source and a conductive surface disposed proximate to the chamber in communication with the voltage source. The conductive surface may be disposed external to the chamber, internal to the chamber, or may be a part of a structure of the chamber.

In other implementations, the voltage pulse applying means comprises a means for controlling the electron beam or the device employed to apply the electron beam.

DETAILED DESCRIPTION OF THE INVENTION

In general, the term "communicate" (for example, a first component "communicates with" or "is in communication with" a second component) is used herein to indicate a structural, functional, mechanical, electrical, optical, magnetic, ionic or fluidic relationship between two or more components or elements. As such, the fact that one component is said to communicate with a second component is not intended to exclude the possibility that additional components may be present between, and/or operatively associated or engaged with, the first and second components.

The subject matter disclosed herein generally relates to ionization of sample materials. Examples of implementations of methods and related devices, apparatus, and/or systems are described in more detail below with reference to FIGS. 1-6. These examples are described in the context of mass spectrometry. However, any process that entails ionization utilizing an electron beam or the like may fall within the scope of this disclosure.

Figure 1:
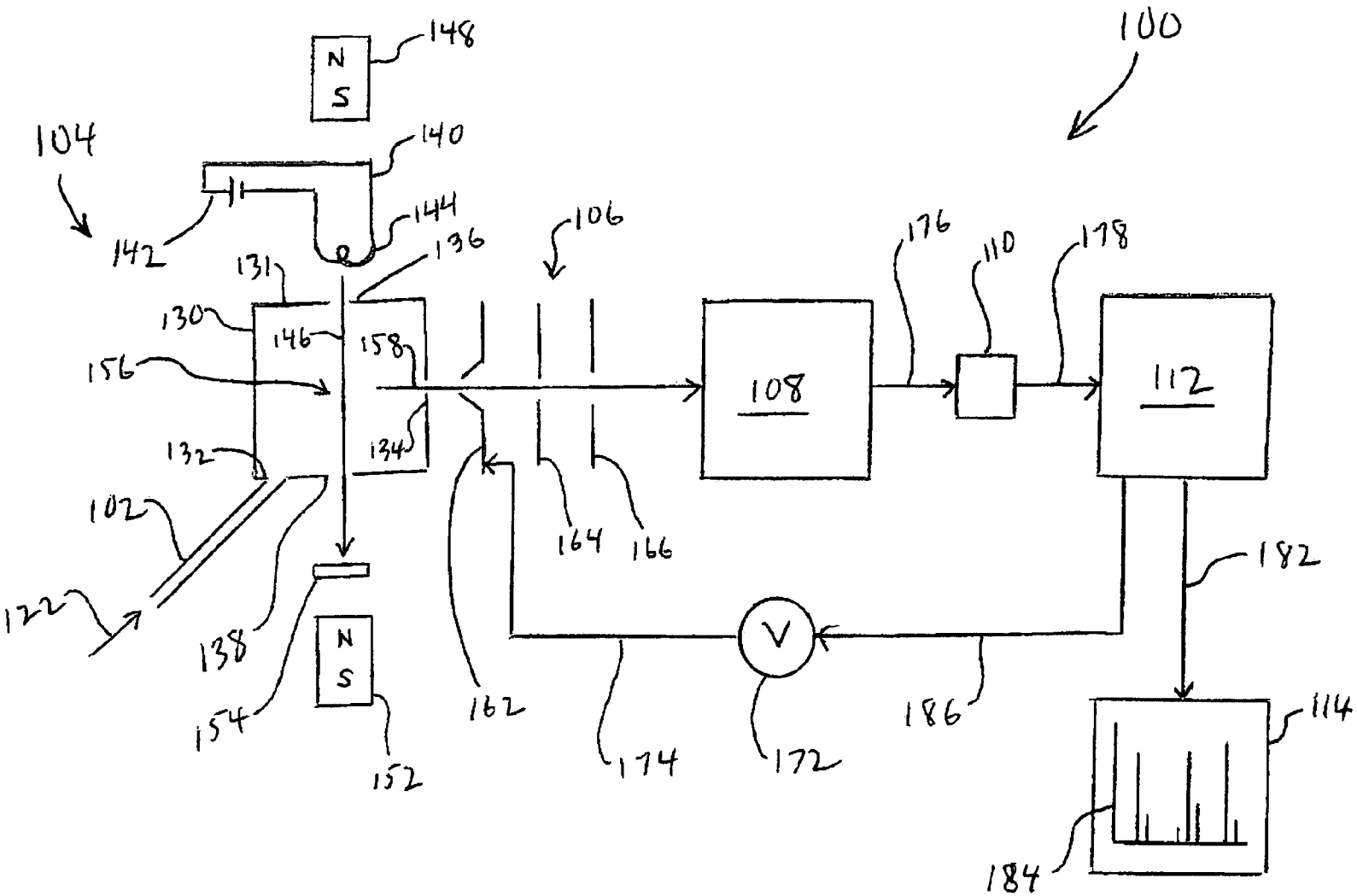
FIG. 1 is a schematic diagram representative of an example of a mass spectrometry system or apparatus in which the subject matter disclosed herein can be implemented, including an example of a configuration of an ion source.

FIG. 1 illustrates certain components that may form a part of a mass spectrometry (MS) system, generally designated 100. The MS system 100 may include a sample inlet system 102, an ion source 104, ion optics 106 (for example, lenses, gates, and the like), a mass analyzer (or mass spectrometer) 108, an ion detector 110, an electronic controller 112 (for example, a signal processor and data acquisition controller), and a readout/display device or devices 114. For simplicity, any other components that may in practice form a part of, or interface with, the representative MS system 100 illustrated in FIG. 1 are not specifically shown, as such components are readily understood by persons skilled in the art.

The sample inlet system 102 may be any system or device suitable for interfacing with the ion source 104 so as to conduct a flow or beam of gaseous sample material 122 into the ion source 104. In a case where the MS system 100 is a continuous-beam system, the sample inlet system 102 is often a gas chromatographic (GC) instrument, which is capable of providing a source of analytes to the MS system 100 at a high, continuous flow rate if desired. The MS system 100 may, however, be capable of implementing hyphenated techniques other than GC/MS such as, for example, LC/MS or MS/MS. As a further alternative, the introduction of sample material into the ion source 104 may be done directly, and not as the output of an upstream analytical instrument.

The ion source 104 may be any ion source that is compatible with the methods disclosed herein and with the type of mass analyzer 108 employed. Insofar as the methods disclosed herein have been tested in connection with ionization driven by electron beams, the ion source 104 is illustrated in FIG. 1 as an electron impact (or electron ionization, EI) ion source 104. It will be appreciated by persons skilled in the art that the MS system 100 may be designed to enable more than one type of ionization technique to be selected, for example, EI or CI (chemical ionization). In the illustrated example, the ion source 104 includes an ionization chamber 130 in which ionization of sample material is carried out. The structure of the ionization chamber 130 may be formed by one or more walls or surfaces 131, and may have a sample inlet aperture 132, an ion exit aperture 134, an electron beam inlet aperture 136, and an electron beam outlet aperture 138. The ion source 104 may also include a suitable electron source 140, such as the type that includes a heater 142 and a thermionic cathode or filament 144 from which electrons are emitted. The ion source 104 may also include guiding, focusing, and/or collimating components as needed to produce a controllable electron beam 146 of desired intensity and coherency that is directed into the ionization chamber 130. In the illustrated example, the ion source 104 includes electron focusing magnets 148 and 152 for this purpose. The electron beam 146 is directed through the ionization chamber 130 via the electron beam inlet aperture 136 and electron beam outlet aperture 138, and is collected at a suitable anode or collector 154. Ionization takes place in an ionization region generally indicated at 156, where components of the sample beam 122 (for example, sample molecules) injected into the ionization chamber 130 are bombarded by the electron beam 146 and ionized thereby.

Once sample material from the sample beam 122 has been ionized, the ions are extracted from the ionization chamber 130 for further processing. The operation of the ion source 104 results in the production of an ion signal, flux, or beam 158 that typically is orthogonal to the sample beam 122 and is directed out from the ionization chamber 130 through the ion exit aperture 134. The process of extracting ions in this manner may be facilitated by the use of the ion optics 106 that are located just downstream of the ionization chamber 130 in close proximity to the ion exit aperture 134. Suitable ion optics 106 of various configurations are widely known and commercially available. As one example, the ion optics 106 may include one or more lenses 162, 164 and 166, including an ion extracting lens 162. The other lenses 164 and 166 may be utilized for focusing and/or accelerating the ions. As schematically illustrated in FIG. 1, the lenses 162, 164 and 166 may be provided in the form of plates, each of which includes at least one aperture or slit through which the ion beam 158 passes, although other known configurations may be employed. In operation, the ion extracting lens 162 is energized by a suitable voltage source 172 via an electrical communication line 174, such that a DC potential is impressed between the ion extracting lens 162 and a conductive surface or component of the ionization chamber 130. The ion extracting lens 162 and the electron source 140 may be active at the same time such that ionization and ion extraction are carried out simultaneously and continuously. The ion extraction voltage applied to the ion extracting lens 162 may be set to a constant value that optimizes the ion beam 158 into the mass analyzer 108 for maximum sensitivity.

The ion beam 158 is then introduced into the mass analyzer 108 via a suitable inlet interface. The mass analyzer 108 may be any type suitable for mass-sorting operations as well as any other operations that may be desired (for example, reaction or fragmentation). Examples of suitable mass analyzers 108 include, but are not limited to, those of the continuous-beam type and multi-quad linear traps. The operation of the mass analyzer 108 results in a mass-discriminated output of ions 176. This ion output or signal 176 is collected by the ion detector 110. The ion detector 110 can be any device capable of converting the ion signal 176 received as an output from the mass analyzer 108 into an electrical signal 178 such as an electrical current. For example, the ion detector 110 may be of the type that includes an electron multiplier (EM) or photomultiplier, although other types of ion detectors 110 may be employed.

The electrical signals 178 produced by the ion detector 110 are fed to the electronic controller 112. As a general matter, the electronic controller 112 illustrated in FIG. 1 is a simplified schematic representation of an electronic or computing operational environment for the MS system 100. As such, the electronic controller 112 may include, or be part of, a computer, microcomputer, microprocessor, microcontroller, analog circuitry, or the like as those terms are understood in the art. The electronic controller 112 may represent or be embodied in more than one processing component. For instance, the electronic controller 112 may comprise a main controlling component such as a computer in combination with one or more other processing components that implement more specific functions, such as signal conditioning, data acquisition, data manipulation, transmission of information or interfacing tasks between components, et cetera. The electronic controller 112 may include signal processing circuitry for conditioning the current signals produced by ion detector 110 in preparation for post-detection processes such as calibration, scaling, readout/display, et cetera. For example, the signal processing circuitry may include a current-to-voltage amplifier for converting current signals (typically on the order of fA to μA) produced by the ion detector 110 to proportional voltage signals. For this purpose, the current-to-voltage amplifier may include an op-amp (operational amplifier) with feedback through a resistor. To convert the data output of a current-to-voltage amplifier from the analog domain to the digital domain in preparation for data manipulation, signal processor may also include an analog-to-digital converter (ADC). The electronic controller 112 may also include data processing circuitry for controlling data acquisition and formatting as needed to generate spectral data resulting from the operation of the MS system 100. Accordingly, the electronic controller 112 may communicate with a readout/display device 114, such as a printer, display screen, or the like, over a data line 182. An example of a mass spectrum 184 generated as a result of the operation of the MS system 100 is illustrated within the readout/display device 114.

In addition to data acquisition, manipulation, storage and output, the electronic controller 112 may implement any number of other functions such as computerized control of one or more components of the MS system 100. For instance, the electronic controller 112 may communicate with the voltage source 172 over a control signal line 186 to control the timing and magnitude of voltages employed for ion extraction, as well as the pulse width and frequency of voltage pulses that may be applied to the ionization chamber 130 in accordance with methods disclosed herein. Although not specifically shown in FIG. 1, the electronic controller 112 may communicate with one or more other components of the MS system 100 for such purposes as optimizing their performance, controlling their operational states, coordinating their operations with the operations of other components, and the like. For example, the electronic controller 112 may implement various aspects of instrumental control such as temperature, flow rate or pressure of the sample beam 122, gating and operational parameters of the electron beam 146, gas or vapor pressure within the ionization chamber 130, ion count within the ionization chamber 130, quadrupole voltages (DC and/or RF) in implementations where quadrupolar components are employed for mass analysis or ion guiding, ion optics voltages, magnetic or electric field strength, gain control of the ion detector 110, scanning parameters, et cetera.

The electronic controller 112 may have both hardware and software attributes. In particular, the electronic controller 112 may be adapted to execute instructions embodied in computer-readable or signal-bearing media for implementing one or more algorithms, methods, or processes employed in one or more operations of the MS system 100. The instructions may be written in any suitable code, one example being C.

As noted previously, in the operation of an ion source such as the ion source 104 illustrated in FIG. 1, the phenomenon of self-oscillation may occur and degrade the performance of the associated MS system 100. This self-oscillation is believed to be engendered by the effects of electron space charge resident in the ionization chamber 130 during the process of ionization. The present disclosure provides a solution for ameliorating the detrimental effects of the self-oscillation phenomenon while, at the same time, .preserving the desired operating conditions of the ion source 104 that maximize its sensitivity. The solution entails stabilizing the ion motions in the ionization chamber 130 by applying a short voltage pulse or series of voltage pulses to the ionization chamber 130 during ionization. It is believed that the effect of the voltage pulse is to perturb the space charge, thereby depleting the number of trapped ions for a period of time and in turn inhibiting the self-oscillation phenomenon. The voltage pulse is applied in a manner that does not interfere with other operations of the ion source 104, or of the MS system 100 as a whole, and that does not alter the mass spectra generated by the MS system 100.

The voltage pulse (or each voltage pulse of a series or train of voltage pulses) may be defined by a controllable pulse width and pulse height (voltage magnitude). In implementations where a plurality of voltage pulses are applied, the voltage pulses are applied at a controllable pulse frequency. The parameters of the voltage pulse or pulses (pulse width, pulse height, and pulse frequency) may depend on several factors, including the type of instruments employed in the MS system 100, the operational limitations of these instruments, and the operating conditions associated with the ion source 104 such as the data sampling rate, the geometry and dimensions of the ionization chamber 130, the pressure within the ionization chamber 130, the mean-free path of particles within the ionization chamber 130, the number of ions within the ionization chamber 130 or their masses or mass ranges, the flow rate of the sample beam 122, the electron emission current of the electron beam 140, the electrical potential driving the electron beam 140, the voltage potential being used to extract ions from the ionization chamber 130, the voltages of conductive surfaces of the ionization chamber 130 such as the walls 131 of the ionization chamber 130 or ion-guiding components located within the ionization chamber 130, and so on.

Generally, the pulse width, pulse height, and pulse frequency are set within ranges of values that are sufficient to perturb the space charge in a manner tat stabilizes the ion instabilities and inhibits the self-oscillation phenomenon as described above. The pulse width may be set to be a fraction (for example, 15% or thereabouts) of the duty (pulse) cycle. That is, the period of time during which the voltage pulse is on may be a predetermined fraction of the period of time between the applied voltage pulses. In some implementations, for example, the pulse width ranges from approximately 2 μs to approximately 20 μs. In a more specific example, the pulse width is approximately 10 μs. The pulse height may be set to be a function of an operating parameter such as electron emission current, and may be varied in accordance with variations in that operating parameter. For instance, the pulse height may be set to automatically increase with increasing electron emission current, either linearly or nonlinearly. As another example, the pulse height may be set to be a function of the pressure in the ionization chamber 130. As a further example, the pulse height may be set to be a function of the scanned ion mass or concentration in the ionization chamber 130. The voltage pulse applied in the ion source 104 may be optimized for the particular ion mass that is scanned and transmitted through the mass analyzer 108 at a particular moment. In some implementations, for example, the pulse height may be in a range from approximately 0 V to approximately 60 V.

The pulse frequency may be selected independently from other operating parameters (i.e., the pulse frequency may be free-running). Alternatively, the pulse frequency may be set to be a function of, and/or synchronized with, the rate or frequency by which data are sampled (data acquisition or collection rate) by the mass analyzer 108. In some implementations, the pulse frequency is set to be higher than the data sampling rate (for example, twice the data sampling rate). For example, if data are sampled every 80 μs, voltage pulses may be applied every 40 μs. Setting the pulse frequency to be higher than the data sampling frequency may be utilized to ensure that no ion signal fluctuations are observed in the mass spectra. Synchronizing the voltage pulses with the data sampling events may be useful in ensuring that no frequency interference (e.g., the aliasing phenomenon) occurs. In some implementations, for example, the pulse frequency ranges from approximately 12 kHz to approximately 50 kHz.

The voltage pulse may be applied such that a pulsatile electrical potential is impressed between the ionization chamber 130 (for example, a wall 131 of the ionization chamber 130) and another conductive surface located anywhere in proximity of the ionization chamber 130, so long as the voltage pulse is sufficient to perturb the space charge in the ionization chamber 130 to effect ion space charge stability. For example, the conductive surface may be positioned externally relative to the ionization chamber 130 if an aperture of the ionization chamber 130—such as the ion exit aperture 134 or the electron beam outlet aperture 138—allows fringing fields to penetrate the interior of the ionization chamber 130. Alternatively, the conductive surface may be positioned within the ionization chamber 130. Implementations for applying the voltage pulse are described below. As a further alternative, an input of energy into the ionization chamber 130, which may be a pre-existing energy input such as the electron beam 146, may be pulsed to attain the same ion-stabilizing effect. Generally, the voltage pulsing according to any of these techniques may be implemented in a manner that does not appreciably change the observed continuous operation of the MS system 100 (e.g., sample introduction, ionization, ion extraction, mass analysis and detection, and the like).

In one implementation, the conductive surface to which the voltage pulse is applied is a conductive surface external to the ionization chamber 130. Specifically, as illustrated in FIG. 1, the ion extracting lens 162 may be employed as the conductive surface. The voltage source 172 may be employed to apply the voltage pulse. Depending on design, the same voltage source 172 may be employed to apply both the voltage pulse and the ion extraction voltage, or physically separate voltage sources may be employed for these functions. Therefore, it will be understood that the voltage source 172 illustrated in FIG. 1 may be representative of one or more voltage sources, and hence the term "voltage source" encompasses one or more voltage sources. The voltage pulse may be superimposed on the ion extraction voltage which, as previously noted, is preferably set to a constant, optimized value. As also previously noted, the pulsing may be carried out within one cycle of data sampling so that there is no appreciable effect of this pulsing on the ions detected through the mass analyzer 108 or in the resulting mass spectra. The operation of the voltage source 172, including the timing of the voltage pulse relative to other functions such as application of the ion extraction voltage and data sampling, may be controlled by the electronic controller 112 via the control signal line 186.

The technique just described has been experimentally tested with very good results, indicating that the performance of the mass spectrometer—in terms of sensitivity, linearity, dynamic range, ion ratios consistency, mass resolution, signal-to-noise (S/N) ratio, and reproducibility—is similar when the pulsed ion extraction lens is employed. At the same time, the phenomenon of ion self-oscillation was inhibited, thereby allowing the ion source to be operated under maximum sensitivity conditions. The operating parameters employed to optimize the performance of the ion source and other components of the mass spectrometer were not adversely affected by the use of voltage pulsing. These experiments demonstrate that the application of a voltage pulse to an ion source is an improvement over ion sources that operate without this new technique of voltage pulsing.

Figure 2:
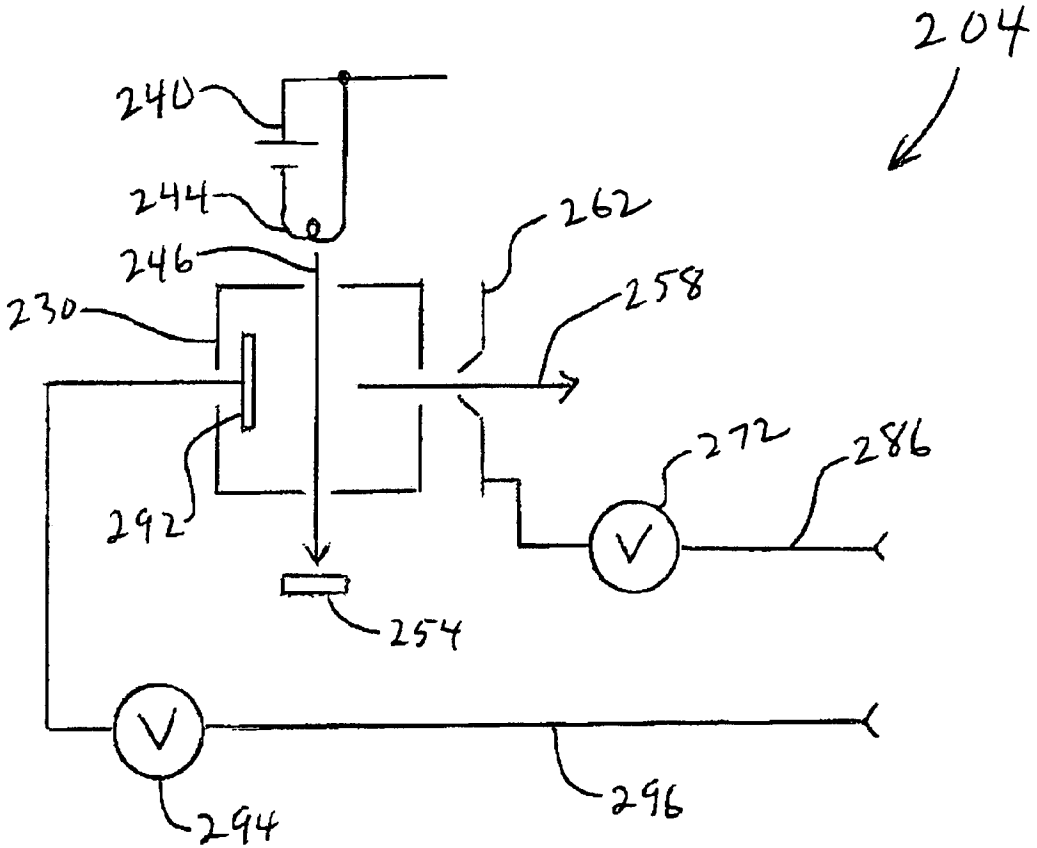
FIG. 2 is a schematic diagram representative of another example of a configuration of an ion source according to an alternative implementation.

FIG. 2 illustrates an implementation in which the voltage pulse is applied to a conductive surface internal to the ionization chamber. In FIG. 2, similar reference numerals are used to designate similar components in comparison with FIG. 1. Accordingly, FIG. 2 illustrates an ion source 204, an ionization chamber 230, an electron source 240 including an electron emitter or filament 244, an electron beam 246, an electron collector 254, an ion beam 258, an ion extracting lens 262, a voltage source 272 communicating with the ion extracting lens 262, and a control signal line 286 communicating with the voltage source 272. The ion source 204 illustrated in FIG. 2 may be implemented in conjunction with the MS system 100 illustrated in FIG. 1. In the example illustrated in FIG. 2, the internal conductive surface to which the voltage pulse is applied is a repeller or reflector electrode 292, which is often disposed in the ionization chamber 230 and employed to establish a voltage potential (for example, with the ion extracting lens 262) to accelerate ions out from the ionization chamber 230 in the form of the ion beam 258. The voltage pulse in this implementation may be applied by a voltage source 294 communicating with the repeller electrode 292. This voltage source 294 may be controlled by signals transmitted over a control signal line 296 from a suitable control means, such as the electronic controller 112 illustrated in FIG. 1. The operation of this ion source 204 is otherwise analogous to the ion source 104 described above and illustrated in FIG. 1.

Figure 3:
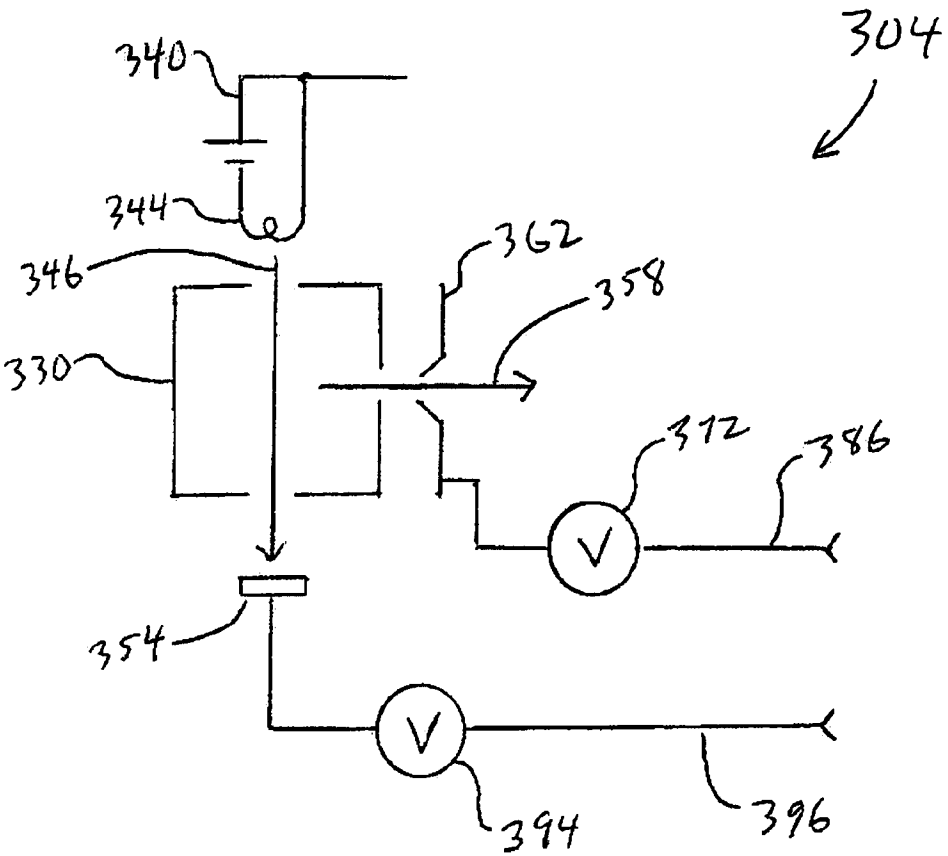
FIG. 3 is a schematic diagram representative of yet another example of a configuration of an ion source according to an alternative implementation.

FIG. 3 illustrates an implementation in which, like the implementation shown in FIG. 1, the voltage pulse is applied to a conductive surface external to the ionization chamber. In FIG. 3, similar reference numerals are used to designate similar components in comparison with FIGS. 1 and 2. Accordingly, FIG. 3 illustrates an ion source 304, an ionization chamber 330, an electron source 340 including an electron emitter or filament 344, an electron beam 346, an electron collector 354, an ion beam 358, an ion extracting lens 362, a voltage source 372 communicating with the ion extracting lens 362, and a control signal line 386 communicating with the voltage source 372. The ion source 304 illustrated in FIG. 3 may be implemented in conjunction with the MS system 100 illustrated in FIG. 1. In the example illustrated in FIG. 3, the external conductive surface to which the voltage pulse is applied is the collector electrode 354 that receives the electron beam 346 directed through the ionization chamber 330. The voltage pulse in this implementation may be applied by a voltage source 394 communicating with the collector electrode 354. This voltage source 394 may be controlled by signals transmitted over a control signal line 396 from a suitable control means, such as the electronic controller 112 illustrated in FIG. 1. The operation of this ion source 304 is otherwise analogous to the ion source 104 described above and illustrated in FIG. 1.

Figure 4:
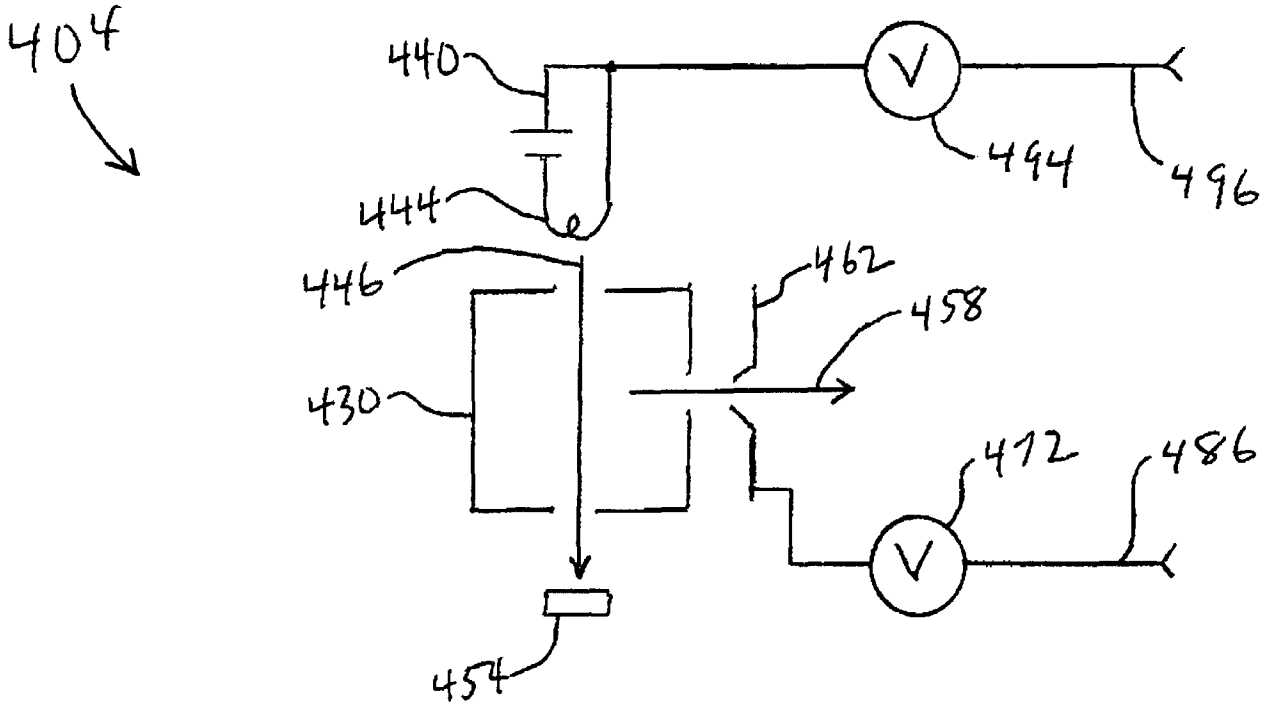
FIG. 4 is a schematic diagram representative of a further example of a configuration of an ion source according to an alternative implementation.

FIG. 4 illustrates an implementation in which an existing source of energy inputted into the ionization chamber is employed to apply the voltage pulse. In FIG. 4, similar reference numerals are used to designate similar components in comparison with FIGS. 1-3. Accordingly, FIG. 4 illustrates an ion source 404, an ionization chamber 430, an electron source 440 including an electron emitter or filament 444, an electron beam 446, an electron collector 454, an ion beam 458, an ion extracting lens 462, a voltage source 472 communicating with the ion extracting lens 462, and a control signal line 486 communicating with the voltage source 472. The ion source 404 illustrated in FIG. 4 may be implemented in conjunction with the MS system 100 illustrated in FIG. 1. In the example illustrated in FIG. 4, the operation of the electron source 440 is controlled by a voltage source 494 so as to pulse the electron beam current. The pulsing of the electron beam current may be effected by, for example, rapidly energizing and de-energizing the filament 444 or activating and de-activating a gating component positioned between the filament 444 and the ionization chamber 430. The voltage source 494 may in turn be controlled by signals transmitted over a control signal line 496 from a suitable control means, such as the electronic controller 112 illustrated in FIG. 1. The operation of this ion source 404 is otherwise analogous to the ion source 104 described above and illustrated in FIG. 1.

Figure 5:
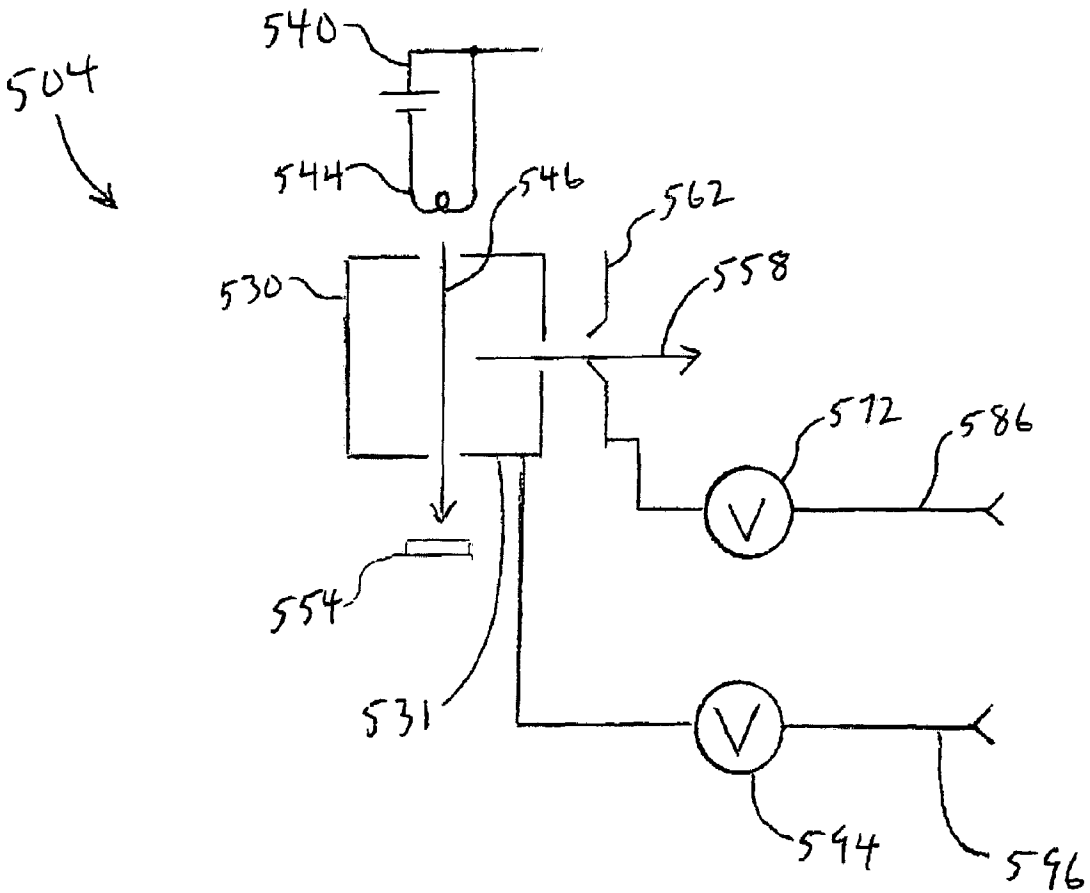
FIG. 5 is a schematic diagram representative of an additional example of a configuration of an ion source according to an alternative implementation.

In the implementations described thus far in conjunction with FIGS. 1-4, it has been assumed that the voltage on the ionization chamber 130 (or 230, 330, or 430) itself (i.e., the walls or structure 131 of the ionization chamber 130) is constant (or grounded) relative to other voltages applied for various purposes such as the guiding of ions. FIG. 5, however, illustrates an implementation in which the voltage pulse is applied directly to the ionization chamber. In FIG. 5, similar reference numerals are used to designate similar components in comparison with FIGS. 1-4. Accordingly, FIG. 5 illustrates an ion source 504, an ionization chamber 530, an electron source 540 including an electron emitter or filament 544, an electron beam 546, an electron collector 554, an ion beam 558, an ion extracting lens 562, a voltage source 572 communicating with the ion extracting lens 562, and a control signal line 586 communicating with the voltage source 572. The ion source 504 illustrated in FIG. 5 may be implemented in conjunction with the MS system 100 illustrated in FIG. 1. In the example illustrated in FIG. 5, the voltage pulse is applied directly to the ionization chamber 530, such that a pulsatile electrical potential is established between the ionization chamber 530 and some other conductive surface associated with the ionization chamber 530—such as an external or internal electrode disposed proximate to the ionization chamber 530—that is sufficient to perturb the space charge in the ionization chamber 530 as previously described. The voltage pulse may be applied directly to the ionization chamber 530 by a voltage source 594 electrically communicating with the ionization chamber 530, such as with a wall 531 of ionization chamber 530. This voltage source 594 may be controlled by signals transmitted over a control signal line 596 from a suitable control means, such as the electronic controller 112 illustrated in FIG. 1. The operation of the ion source 504 of this implementation is otherwise analogous to the ion source 104 described above and illustrated in FIG. 1.

Figure 6:
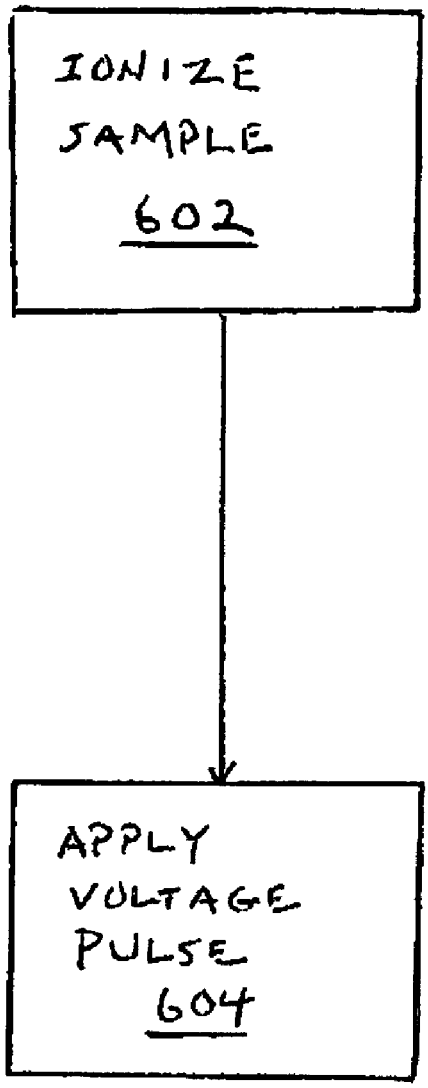
FIG. 6 is a flow diagram illustrating an example of a method for inhibiting space charge-related effects in an ion source, as disclosed herein.

Referring to the flow diagram of FIG. 6, a method for inhibiting space charge-related effects in an ion source is illustrated according to one implementation. At block 602, an electron beam is directed into a chamber to produce ions from sample material in the chamber. At block 604, a voltage pulse is applied to the chamber to perturb an electron space charge present in the chamber. The chamber may be an ionization chamber as described above in conjunction with any of FIGS. 1-5 (for example, ionization chamber 130, 230, 330, 430, or 530) that is part of a suitable ion source (for example, ion source 104, 204, 304, 404, or 504). The ion source may operate in conjunction with, or form a part of, a larger system such as a sample analyzing system. For example, the system may be a mass spectrometry system such as the MS system 100 illustrated in FIG. 1. Various techniques may be implemented for applying the voltage pulse to the chamber, examples of which are described above. In some implementations, the voltage pulse is applied to a conductive surface located externally relative to the chamber. In other implementations, the voltage pulse is applied to a conductive surface located inside the chamber. In other implementations, the voltage pulse is applied to a conductive surface of the chamber itself, such as a wall of the chamber. In other implementations, the voltage pulse is applied as part of an energy input into the chamber, such as by pulsing the electron beam.

It will be understood that the methods disclosed herein may be implemented in conjunction with hyphenated techniques such as, for example, the afore-mentioned GC/MS technique, as well as in other hyphenated techniques such as tandem MS or MS/MS. For instance, in tandem MS, more than one mass analyzer (and more than one type of mass analyzer) may be used. As one example, an ion source may be coupled to a multipole (for example, quadrupole) structure that acts as a first stage of mass separation to isolate molecular ions of a mixture. The first analyzer may in turn be coupled to another multipole structure (normally operated in an RF-only mode) that performs a collision-focusing function and is often termed a collision chamber or collision cell. A suitable collision gas such as argon is injected into the collision cell to cause fragmentation of the ions and thereby produce daughter ions. This second multipole structure may in turn be coupled to yet another multipole structure that acts as a second stage of mass separation to scan the daughter ions. Finally, the output of the second stage is coupled to an ion detector. Instead of multipole structures, magnetic and/or electrostatic sectors may be employed. Other examples of MS/MS systems include the Varian Inc. 1200 series of triple-quadrupole GC/MS systems commercially available from Varian, Inc., Palo Alto, Calif., and the implementations disclosed in U.S. Pat. No. 6,576,897, assigned to the assignee of the present disclosure.

It will also be understood, and is appreciated by persons skilled in the art, that one or more processes, sub-processes, or process steps carried out in the mass spectrometer, ion source, and/or one or more voltage sources, such as the processes and apparatus described with reference to FIGS. 1-6, may be performed or controlled by hardware and/or software. If a process is performed by software, the software may reside in software memory (not shown) in a suitable electronic processing component or system such as, for example, the electronic controller 112 schematically depicted in FIG. 1. The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any computer-readable (or signal-bearing) medium for use by or in connection with an instruction execution system, apparatus, or device, such as a computer-based system, processor-containing system, or other system that may selectively fetch the instructions from the instruction execution system, apparatus, or device and execute the instructions, one example being the electronic controller 112 schematically depicted in FIG. 1. In the context of the present disclosure, a "computer-readable medium" and/or "signal-bearing medium" is any means that may contain, store, communicate, propagate, or transport the program for use by or in connection with the instruction execution system, apparatus, or device. The computer readable medium may selectively be, for example, but is not limited to, an electronic, magnetic, optical, electromagnetic, infrared, or semiconductor system, apparatus, device, or propagation medium. More specific examples, but nonetheless a non-exhaustive list, of computer-readable media would include the following: an electrical connection (electronic) having one or more wires, a portable computer diskette (magnetic), a random-access memory "RAM" (electronic), a read-only memory "ROM" (electronic), an erasable programmable read-only memory (EPROM or Flash memory) (electronic), an optical fiber (optical), and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for inhibiting space charge-related effects in an ion source, comprising:

directing an electron beam into a chamber to produce ions from sample material in the chamber;

applying an extraction voltage to the chamber to cause emission of ions from the chamber; and applying a voltage pulse to the chamber to perturb an electron space charge present in the chamber, wherein ionization and ion extraction are carried out simultaneously.

2. The method of claim 1, wherein applying the voltage pulse comprises applying a periodic voltage pulse comprising a plurality of individual voltage pulses.

3. The method of claim 2, wherein the each individual voltage pulse has a pulse width that is a fraction of the period of time between the individual voltage pulses.

4. The method of claim 2, wherein the periodic voltage pulse is applied at a pulsing frequency that is higher than a data sampling frequency at which data are acquired from the ions produced in the chamber.

5. The method of claim 4, wherein the pulsing frequency is approximately twice the data sampling frequency.

6. The method of claim 1, comprising synchronizing the timing of the voltage pulse with the timing at which data are acquired from the ions produced in the chamber.

7. The method of claim 1, comprising selecting the height of the voltage pulse to be a function of the electron emission current of the electron beam.

8. The method of claim 1, comprising selecting the height of the voltage pulse to be a function of the pressure in the chamber.

9. The method of claim 1, comprising selecting the height of the voltage pulse to be a function of the mass of ions in the chamber.

10. The method of claim 1, wherein the voltage pulse is applied to a conductive surface disposed proximate to an aperture of the chamber, whereby a pulsatile voltage potential is impressed between the conductive surface and a surface in the chamber.

11. The method of claim 10, wherein the conductive surface is external to the chamber.

12. The method of claim 11, wherein the conductive surface comprises an ion extracting lens.

13. The method of claim 1, wherein the extraction voltage is applied at a constant value.

14. The method of claim 1, wherein the extraction voltage is set to a selected value that optimizes an ion signal emitted from the ion exit aperture for use by a mass analyzer.

15. The method of claim 11, wherein the conductive surface comprises an electron collecting electrode.

16. The method of claim 10, wherein the conductive surface is internal to the chamber.

17. The method of claim 16, wherein the conductive surface comprises a repeller electrode.

18. The method of claim 1, wherein applying the voltage pulse comprises pulsing the electron beam.

19. The method of claim 1, wherein the voltage pulse is applied to a wall of the chamber, whereby a pulsatile voltage potential is impressed between the wall and a conductive surface disposed in the chamber.

20. An ionization apparatus, comprising:

a chamber;

an electron source for directing an electron beam into the chamber;

means for applying an extraction voltage to the chamber to cause emission of ions from the chamber; and means for applying a voltage pulse to the chamber to perturb an electron space charge present in the chamber;

said means for applying an extraction voltage and means for applying a voltage pulse providing ionization and ions extraction simultaneously and continuously.

21. The apparatus of claim 20, wherein the voltage pulse applying means comprises a voltage source and a conductive surface disposed proximate to the chamber in communication with the voltage source, and the conductive surface is disposed external to the chamber, internal to the chamber, or is a part of a structure of the chamber.

22. The apparatus of claim 20, wherein the voltage pulse applying means comprises a means for controlling the electron source.

23. The method of claim 1, wherein applying the voltage pulse and applying the extraction voltage cooperatively produce a substantially continuous ion beam characterized by reduced ion self-oscillation.

24. The method of claim 18, further including synchronizing the pulsing of the electron beam with the timing at which data are acquired from the ions produced in the chamber.

25. The apparatus of claim 20, further including means for controlling the voltage pulse applying means based on a parameter selected from the group consisting of a data sampling frequency at which data are acquired from the ions produced in the chamber, the electron emission current of the electron beam, the pressure in the chamber, the mass of ions in the chamber, and two or more of the foregoing.

* * * * *